US006247909B1

(12) United States Patent
Williams et al.

(10) Patent No.: US 6,247,909 B1
(45) Date of Patent: Jun. 19, 2001

(54) BEARING ASSEMBLY FOR SEALED COMPRESSOR

(75) Inventors: John R. Williams; Tracy Milliff; Joe T. Hill, all of Bristol, VA (US); Gene Michael Fields, Arkadelphia, AR (US); Michael R. Young, Bristol, TN (US)

(73) Assignee: Scroll Technologies, Arkadelphia, AK (US)

( * ) Notice: Subject to any disclaimer, the term of this patent is extended or adjusted under 35 U.S.C. 154(b) by 0 days.

(21) Appl. No.: 09/376,915

(22) Filed: Aug. 18, 1999

(51) Int. Cl.[7] ..... F04C 18/04; F04C 29/02

(52) U.S. Cl. ..... 418/55.1; 418/55.6; 418/94; 184/6.18

(58) Field of Search ..... 418/55.6, 94, 55.1; 417/902; 184/6.16, 6.18

(56) References Cited

U.S. PATENT DOCUMENTS

| | | | | |
|---|---|---|---|---|
| 1,964,415 | * | 6/1934 | Van Deventer | 418/94 |
| 2,628,765 | * | 2/1953 | Anderson | 417/902 |
| 4,585,403 | * | 4/1986 | Inaba et al. | 418/94 |
| 5,098,265 | * | 3/1992 | Machida et al. | 418/55.6 |
| 5,232,355 | * | 8/1993 | Fujii et al. | 418/55.6 |

FOREIGN PATENT DOCUMENTS

| | | | | |
|---|---|---|---|---|
| 0520517 | | 6/1992 | (EP) . | |
| 0539239 | | 10/1992 | (EP) . | |
| 59-028088 | | 2/1984 | (JP) . | |
| 1-290991 | * | 11/1989 | (JP) | 418/55.6 |
| 2033481 | | 2/1990 | (JP) . | |
| 2-264174 | * | 10/1990 | (JP) | 418/55.6 |
| 5113182 | | 7/1993 | (JP) . | |
| 6221280 | | 9/1994 | (JP) . | |
| 6-280757 | * | 10/1994 | (JP) | 418/55.6 |
| 2005915 | * | 1/1994 | (RU) | 418/94 |

* cited by examiner

*Primary Examiner*—John J. Vrablik
(74) *Attorney, Agent, or Firm*—Carlson, Gaskey & Olds

(57) ABSTRACT

A scroll compressor is provided within a sealed housing. Although the invention is shown with regard to a scroll compressor, it should be understood that aspects of the invention have benefit to any type sealed compressor. A lower bearing is attached directly to a housing end cap. The lower bearing is easily and accurately attached to the end cap, and reduces the complexity and cost of assembly of a sealed compressor. In particular, the end cap is provided with upset portions spaced circumferentially by gaps. The bearing is secured to the upset portions by welding. Oil can flow through the gaps and into a space beneath the bearing such that it can reach oil passages in the shaft.

10 Claims, 4 Drawing Sheets

BEARING ASSEMBLY FOR SEALED COMPRESSOR

BACKGROUND OF THE INVENTION

This invention relates to an improved bearing assembly for mounting the lower end of a sealed compressor.

Refrigerant compressors, such as are utilized in air conditioning systems, are typically enclosed in a sealed housing. The housing encloses a motor and a compressor pump unit. Sections of the housing surrounding the motor are exposed to the refrigerant at either a suction or discharge pressure. This type of housing has become very widely utilized in refrigerant compression applications.

The housing must be sealed against leakage of the refrigerant between the suction and discharge sections within the housing, and outwardly of the housing. Further, a number of components must be mounted within the housing. Achieving all of these goals has made compressor assembly somewhat complex. Thus, it is a desire of the compressor assembly workers to minimize the assembly steps and time consumed for assembling a compressor.

Typically, a motor drives a shaft which in turn drives components of the pump unit. Oil is circulated within the shaft, and upwardly to the compressor pump unit. Typically, the shaft has been mounted at a lower bearing on an opposed side of the motor from the pump unit. This lower bearing has typically been secured to the housing at the outer periphery of the bearing, and generally to the housing side wall. The sealed compressor housings are typically formed of a cylindrical housing shell having end caps at both ends. The bearing is supported on the shell, and not the end caps. This has caused a good deal of additional assembly complexity, and has increased the time and expense for assembling the compressor units.

SUMMARY OF THE INVENTION

In a disclosed embodiment of this invention, a sealed compressor has a lower bearing secured to the end cap. The end cap may be a stamped item which is made quite inexpensively. The bearing may be quickly welded to the end cap, and the shaft and pump unit assembled into the bearing. Preferably, structure is supplied between the end cap and the bearing such that the weld contact area does not surround the entire circumference of the bearing. In this way, oil can flow upwardly through the bearing and to the shaft.

In one preferred embodiment of this invention, a series of upset portions are formed extending upwardly from a bottom wall of the end cap. The bearing is positioned on the upset portions, and is resistance-welded to the upset portions. The upset portions are formed at circumferentially spaced locations. Thus, there are passages between the upset portions leading into the bottom of the bearing. Oil which is beneath the bearing, and in the sump of the compressor, can move upwardly through these spaces into the bottom of the bearing. This oil can then pass upwardly through the shaft into the compressor pump unit. The use of the stamped end cap allows quick and easy alignment and attachment of the bearing at its desired position such that the assembly of the bearing is greatly reduced compared to the prior art.

In manufacturing methods, the bearing can be welded to the end cap either before or after the end cap is attached to the center shell.

These and other features of the present invention can be best understood from the following specification and drawings, the following of which is a brief description.

DETAILED DESCRIPTION OF A PREFERRED EMBODIMENT

Figure 1:
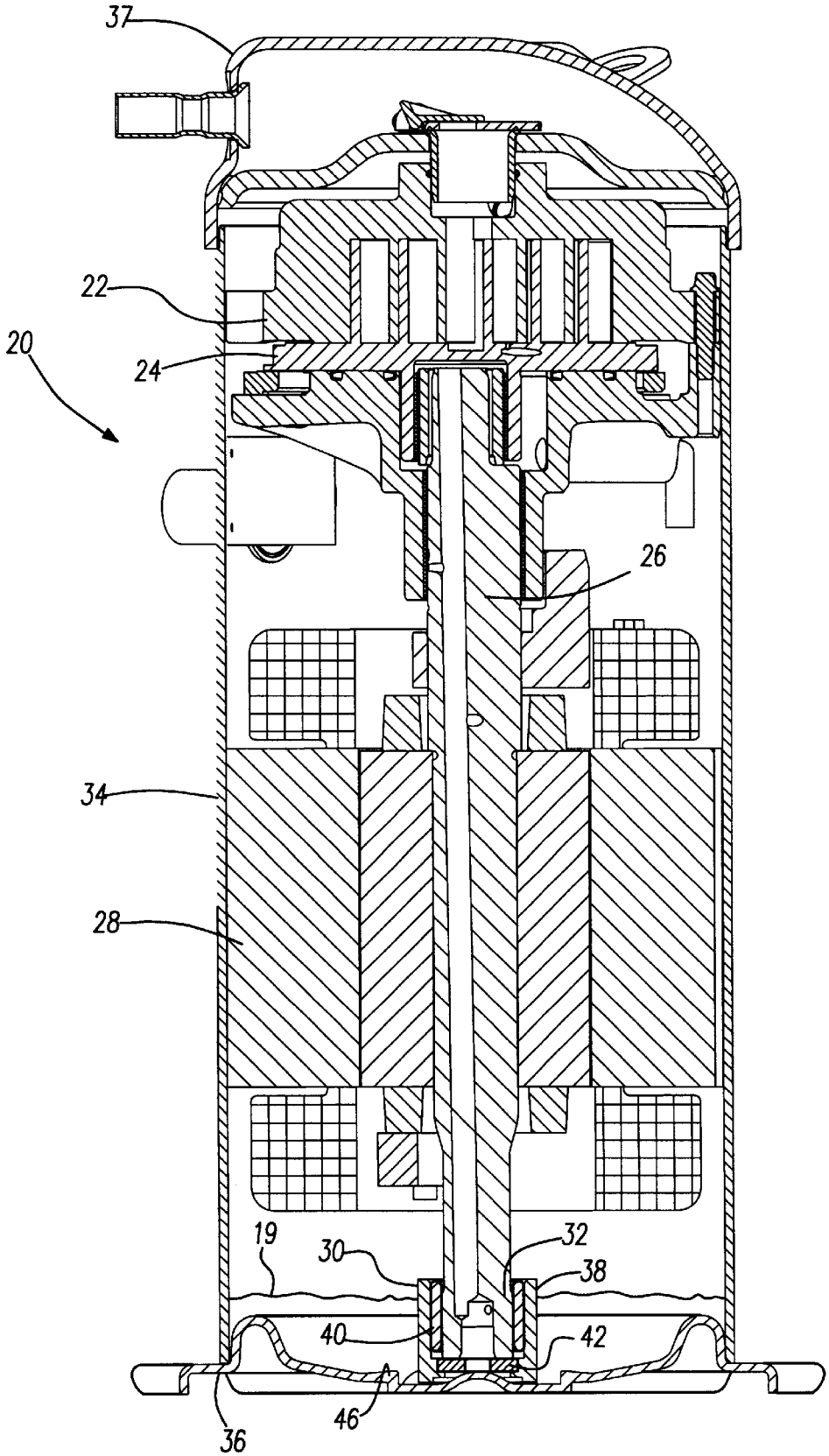
FIG. 1 is a cross-sectional view of a compressor incorporating the present invention.

A compressor 20 is shown in FIG. 1 as a scroll compressor including a non-orbiting scroll 22 and an orbiting scroll 24. The orbiting scroll 24 is driven by a shaft 26 which is in turn driven by a motor 28. A lower bearing assembly 30 mounts a lower end 32 of the shaft 26. As shown, the housing for the compressor includes a cylindrical shell 34, and lower end cap 36 and an upper end cap 37.

The bearing assembly 30 includes a steel bearing shell 38 and an inner bearing member 40 received within the shell 38. A thrust washer 42 is positioned between the bottom wall of the bearing 38 and an end wall of the shaft portion 32.

Figure 2:
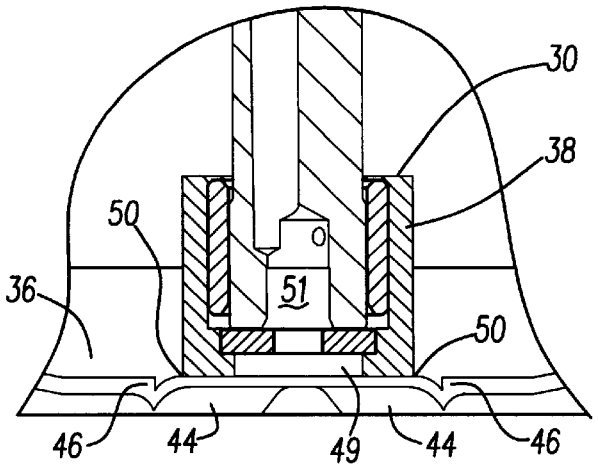
FIG. 2 is an enlarged view of the lower bearing.

As shown in FIG. 2, the end cap 36 has upset portions 44 deformed upwardly toward the end of the shaft 32. An outer ridge 46 assists in centering the bearing shell 38, as will be disclosed below. Gaps 48 between the upset portions 44 allow for oil flow into a chamber 49 below the bearing shell 38. The bearing shell 38 is actually attached to the end cap 36 only at areas 50, which are associated with the upset portions 44. As shown, a lubricant 19 level is received within the housing and above end cap 36, at least partially surrounding the bearing assembly 30. Thus, oil can flow upwardly through the gaps 48 into space 49, and through a passage 51 in the shaft 32 to the pump unit.

Figure 3:
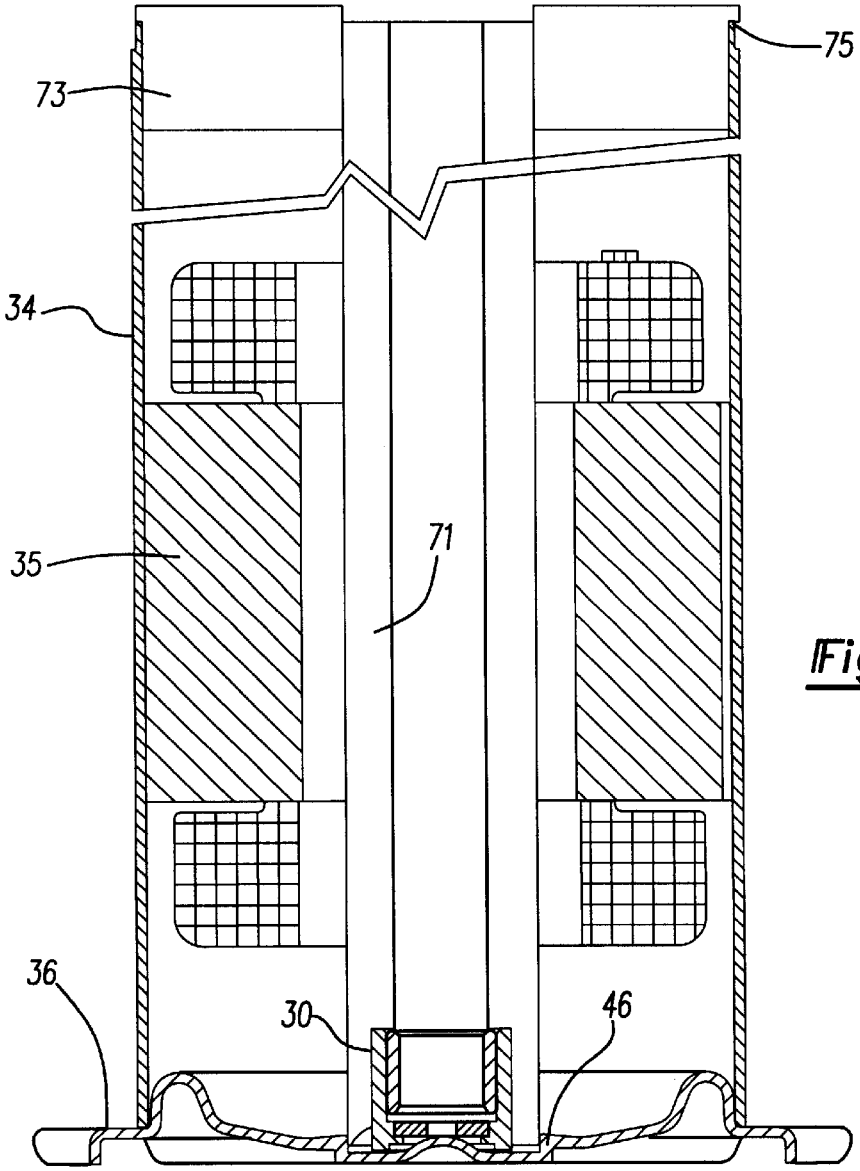
FIG. 3 shows an intermediate assembly step according to one method of the present invention.

As shown in FIG. 3, shell 34 is provided with the stator 35 of the motor, and the end cap 36 welded to the shell 34. In one method, a tool 71, shown schematically, is preferably an arbor carries the bearing assembly 30 downwardly and places it on the end cap 36. The structure 46 allows the tool to center the bearing, by a press fit or expanding fixture 73 which center the arbor relative to the inner diameter of shell 34. Tool 71 moves within fixture 73.

The tool 71 is provided with resistance welding function, and the bearing 30 is welded to the upset portions 44 at this time. The remainder of the assembly can then be completed. In this way, there is no need to be accurate in positioning the end cap relative to the center shell. The centering of the bearing is off the shell inner diameter.

Figure 4:
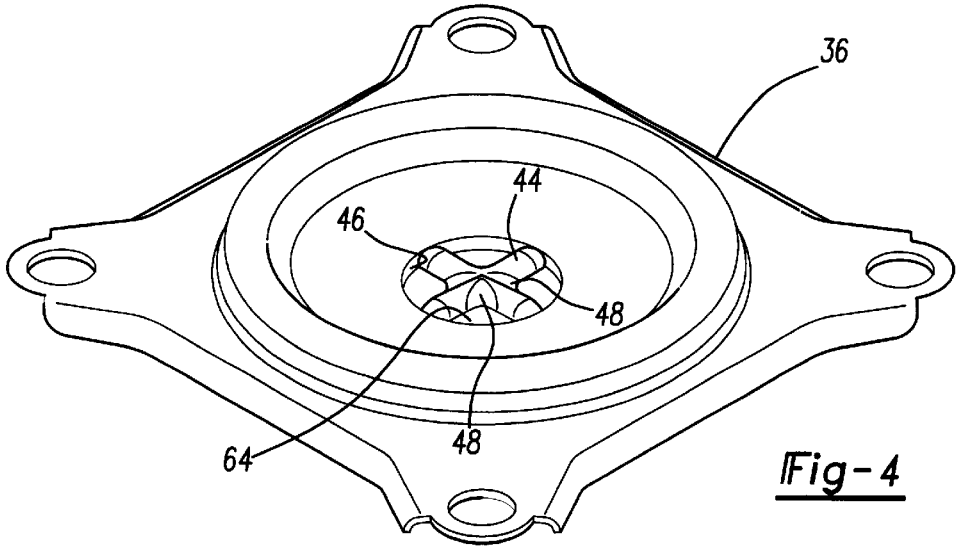
FIG. 4 shows an end cap.

As shown in FIG. 4, the end cap 36 includes four upset portions 44 extending inwardly from centering portion 46. The gaps 48 extend upwardly from a planar surface 64. Although four upset portions are shown, other numbers may be utilized. It may be that three is the preferred number of upset portions, as this will increase the oil flow cross section by increasing the size of the gaps 48.

Figure 5:
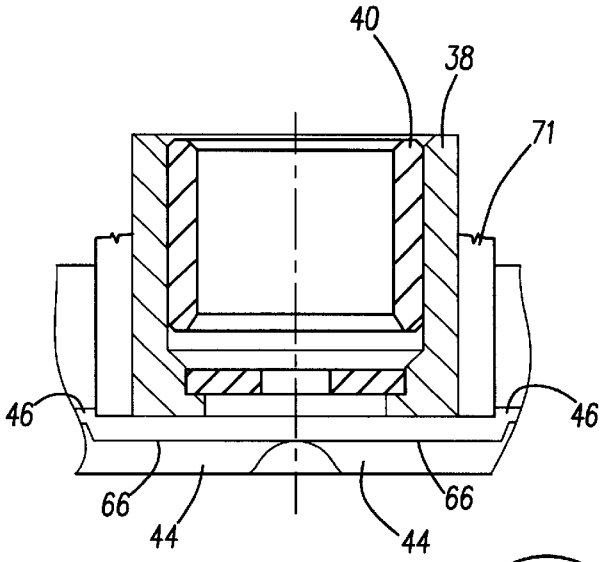
FIG. 5 shows the bearing and end cap prior to attachment of the shaft.

As shown in FIG. 5, prior to insertion of the shaft, the bearing shell 38 has a sacrificial weld ring 66. The weld ring 66 is brought into contact with the surfaces 50 and the upset portions 44. A resistance welding tool, shown schematically combined with the arbor at 71, welds the bearing shell 38 to the end cap 36.

Figure 6:
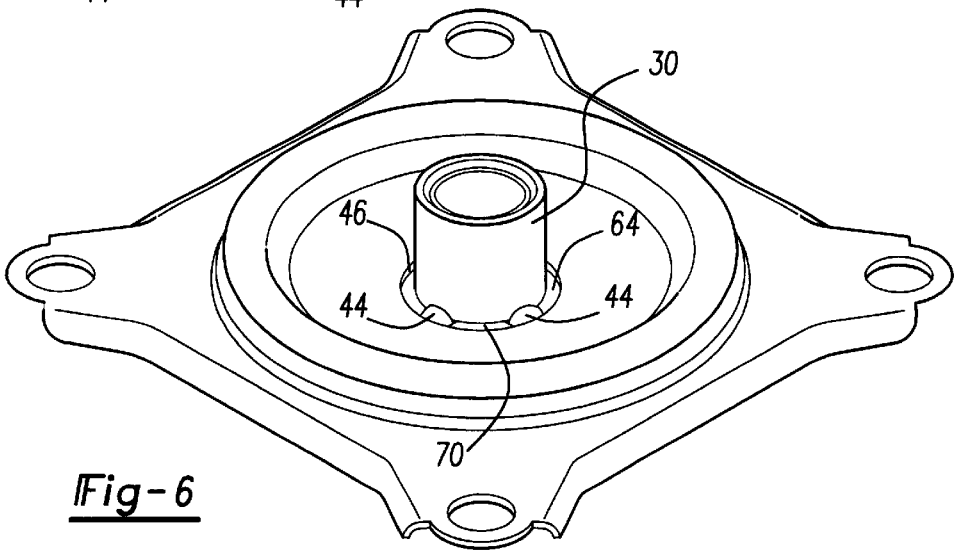
FIG. 6 is a perspective view of the bearing and end cap arrangement.

Now, it should be understood that the present invention provides a bearing shell 38 which may be easily and accurately attached within the compressor shell. As shown in FIG. 6, the compressor bearing 30 is mounted to the upset portions 44. Passages 70 are formed by the gaps 48 and the surface 64 such that oil can flow into the chamber 49, such as shown in FIG. 2. The present invention thus simplifies the assembly of sealed compressors.

Figure 7:
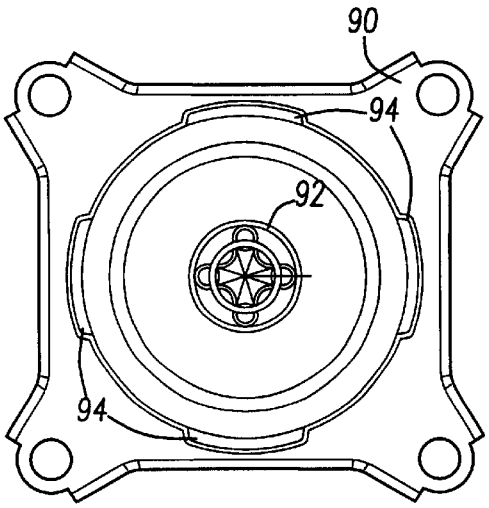
FIG. 7 is an end view of one alternative embodiment.

FIG. 7 shows another alternative embodiment end cap 90. End plate 90 receives the bearing 92 as in the prior embodiments. However, there are spaced guiding ribs 94 in the FIG. 7 embodiment. These spaced guiding ribs will be explained in greater detail below.

Figure 8:
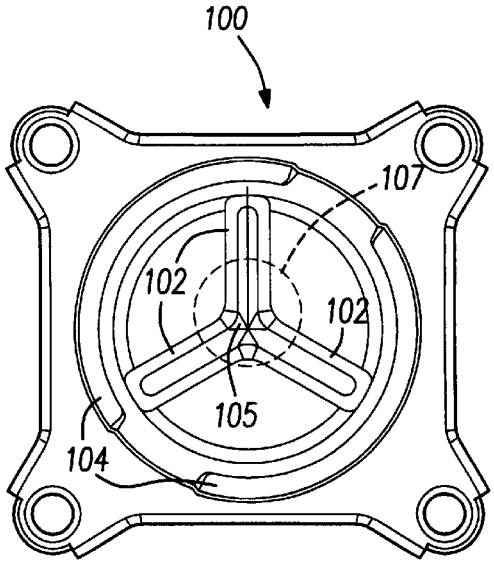
FIG. 8 is an end view of another alternative embodiment.

FIG. 8 shows another embodiment 100 wherein the upset portions 102 extend radially outwardly for a greater extent than in earlier embodiments. As shown, there may be three upset portions. Of course, there could be two, or greater numbers of the upset portions. The guiding ribs 104 is this embodiment extend for a relatively great circumferential extent. Spaces between the guiding ribs allow for the placement of a weld seam from the center shell. A central area 105 on the end cap receives the bearing, as shown generally in phantom at 107.

Figure 9:
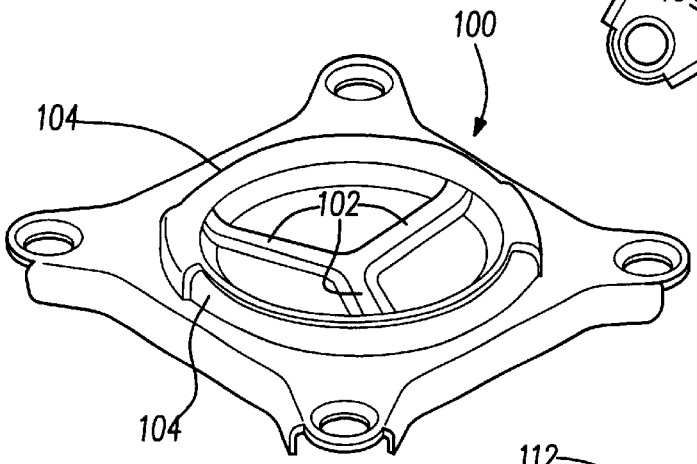
FIG. 9 is a perspective view of the FIG. 8 embodiment.

As can be seen in FIG. 9, the upset portions 102 extend outwardly. The guiding ribs 104 are formed at an outer peripheral location.

Figure 10:
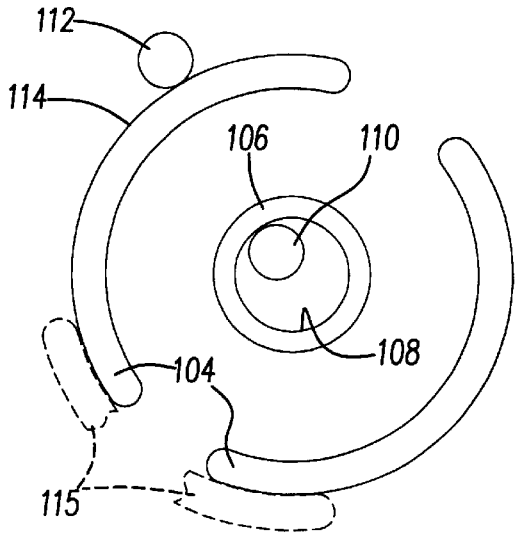
FIG. 10 shows an alternative method step.

The method of manufacture and assembly of the compressor utilizing the FIG. 7–9 embodiments can be best understood from FIG. 10. As shown, a bearing 106 is initially placed on the end plate. A tool 110 and 112, shown schematically, then final grinds the bearing bore 108, along with the outer peripheral surface 114 of the ribs 104. The outer peripheral surface of the ribs 104 will now have the bore 108 exactly centered. The outer surface 104 will then serve as a precise guiding structure when the combined end cap and bearing is positioned within the center shell. In this way, the center shell is properly positioned relative bearing bore 108.

In a method according to these embodiments, the outer guiding surfaces 104 (or 94) are machined to be concentric with the bore 108. The combined end plate and bearing may then be easily placed within the center shell, and proper positioning of the bearing is assured.

As shown in phantom at 115, the center shell is then received outwardly of the guide ribs, and secured to the base of the end plate by welding. The guide ribs thus act to ensure that the center shell is concentric with the bore 108.

Although upset portions on the end plate are disclosed, it should be understood that similar structure could be formed on the bottom of the bearing. Further, rather than having the gaps between the upset portions and the bearing, it may be also be possible to have holes extending through the bearing. These holes would allow the flow of lubricant into the space as does the space between the upset portions.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A compressor comprising:

a compressor pump unit;

a housing surrounding said compressor pump unit, said housing having a cylindrical center shell extending between a pair of end caps, said compressor pump unit being mounted adjacent a first of said end caps;

a motor mounted within said shell, and a shaft driven by said motor for driving said compressor pump unit, an end of said shaft opposed from said pump unit being mounted in a lower bearing, said lower bearing being secured directly to a second end cap, said second end cap being a stamped steel member, said bearing including a bearing shell mounted to said stamped steel member, and said lower bearing being positioned vertically below said motor, said second end cap providing an end wall for an oil sump, said oil sump surrounding at least a vertically lower position of said lower bearing.

2. A compressor as recited in claim 1, wherein said compressor pump unit is a scroll compressor.

3. A compressor as recited in claim 1, wherein said lower bearing is positioned concentrically inwardly of guiding ribs on said second end cap.

4. A compressor comprising:

a compressor pump unit;

a housing surrounding said compressor pump unit, said housing having a cylindrical center shell extending between a pair of end caps, said compressor pump unit being mounted adjacent a first of said end caps;

a motor mounted within said shell, and a shaft driven by said motor for driving said compressor pump unit, an end of said shaft opposed from said pump unit being mounted in a lower bearing, said lower bearing being secured directly to a second end cap; and said second end cap is a stamped steel member having a plurality of upset portions extending upwardly towards said bearing and spaced by gaps, said bearing being attached to said second end cap at said upset portions but axially spaced from said end cap at areas circumferentially aligned with said gaps.

5. A compressor as recited in claim 4, wherein said gaps allowing oil to flow upwardly into said bearing.

6. A compressor as recited in claim 4, wherein there being at least two of said upset portions.

7. A compressor as recited in claim 4, wherein said bearing is formed with a sacrificial ring, said sacrificial ring being brought into contact with said upset portions, and a weld tool, then welding said bearing to said upset portions by said sacrificial ring.

8. A compressor comprising:

a compressor pump unit;

a housing surrounding said compressor pump unit, said housing having a cylindrical center shell extending between a pair of end caps, said compressor pump unit being mounted adjacent a first of said end caps;

a motor mounted within said shell, and a shaft driven by said motor for driving said compressor pump unit, an end of said shaft opposed from said pump unit being mounted in a lower bearing, said lower bearing being secured directly to a second end cap;

said lower bearing being positioned concentrically inwardly of guiding ribs on said second end cap; and said guiding ribs do not extend for the entire circumference of said end plate, but instead have circumferential spaces.

9. A compressor as recited in claim 8, wherein said center shell is positioned on said guiding ribs, to position said center shell accurately with said lower bearing.

10. A compressor comprising:

a scroll compressor pump unit;

a housing surrounding said compressor pump unit, said housing having a cylindrical side shell extending between upper and lower end caps, said compressor pump unit being mounted adjacent said upper end cap;

a motor mounted within said shell, and a shaft driven by said motor for driving said compressor pump unit, an end of said shaft opposed from said pump unit being mounted in a lower bearing, said lower bearing being secured directly to said lower end cap, there being upset portions on said lower end cap which are welded to said lower bearing, gaps between said upset portions allowing oil to flow into said lower bearing.

* * * * *

UNITED STATES PATENT AND TRADEMARK OFFICE

CERTIFICATE OF CORRECTION

PATENT NO. : 6,247,909 B1
DATED : June 19, 2001
INVENTOR(S) : John R. Williams, Tracy Milliff, Joe T. Hill, Gene Michael Fields and Michael R. You It is certified that error appears in the above-identified patent and that said Letters Patent is hereby corrected as shown below:

Title page.
Delete Item [73] and insert therefore:
[73] Assignee: Scroll Technologies, Arkadelphia, AR (US)

Signed and Sealed this

Twenty-third Day of April, 2002

*Attest:*

*Attesting Officer*

JAMES E. ROGAN
*Director of the United States Patent and Trademark Office*